US007866785B2

(12) United States Patent
Hayashi

(10) Patent No.: US 7,866,785 B2
(45) Date of Patent: Jan. 11, 2011

(54) DROPLET-EJECTION DETECTING DEVICE AND RECORDING APPARATUS

(75) Inventor: Toshihiro Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 177 days.

(21) Appl. No.: 12/250,736

(22) Filed: Oct. 14, 2008

(65) Prior Publication Data

US 2009/0096826 A1 Apr. 16, 2009

(30) Foreign Application Priority Data

Oct. 15, 2007 (JP) ..... 2007-268349

(51) Int. Cl.
*B41J 2/01* (2006.01)

(52) U.S. Cl. ..... 347/19

(58) Field of Classification Search ..... 347/19
See application file for complete search history.

(56) References Cited

U.S. PATENT DOCUMENTS 5,304,814 A * 4/1994 Markham ..... 250/573
5,621,524 A * 4/1997 Mitani ..... 356/338
7,490,918 B2 * 2/2009 Nagashima ..... 347/19
2006/0279601 A1 * 12/2006 Unosawa et al. ..... 347/19
2007/0024658 A1 * 2/2007 Diol et al. ..... 347/19
2009/0273620 A1 * 11/2009 Govyadinov et al. ..... 347/9

FOREIGN PATENT DOCUMENTS

| | | |
|---|---|---|
| JP | 11-179884 | 7/1999 |
| JP | 2000-326524 | 11/2000 |
| JP | 2005-280351 | 10/2005 |
| JP | 2006-047235 | * 2/2006 |
| JP | 2006-123203 | 5/2006 |

* cited by examiner

*Primary Examiner*—Huan H Tran
(74) *Attorney, Agent, or Firm*—Workman Nydegger

(57) ABSTRACT

A droplet-ejection detecting device for detecting ejection of droplets from a plurality of nozzle orifices, includes: a beam scanning mechanism which scans a plurality of droplet ejection lines along which droplets ejected from the nozzle orifices fly, by emitting a beam to intersect the droplet ejection lines, thereby subjecting the droplets to irradiation with the beam; a light receiving unit which receives light obtained as a result of the irradiation; and an ejection determining mechanism which determines safe ejections of the droplets from the nozzle orifices based on a received-light signal output from the light receiving unit.

7 Claims, 16 Drawing Sheets

FIRST SCAN

SECOND SCAN

THIRD SCAN

FOURTH SCAN

FIRST SCAN

SECOND SCAN

THIRD SCAN

FOURTH SCAN

DROPLET-EJECTION DETECTING DEVICE AND RECORDING APPARATUS

BACKGROUND

1. Technical Field

The present invention relates to a droplet-ejection detecting device which detects ejections from nozzle orifices of a droplet ejecting head module and a recording apparatus incorporating the droplet-ejection detecting device.

Here, the word "recording apparatus" represents concepts including, for example, a printer (a serial printer, a line printer or the like), a facsimile and a copying machine. Also, the word "droplet ejecting head module" represents concepts including the "recording head module" of the "recording apparatus". The word "recording head module" represents concepts including a recording head module mounted on a carriage which reciprocally moves in the width or line direction of recording and a fixed recording head module, so-called full-line type, mounted in the line printer which has a number of nozzle orifices arrayed over the entire length of the line of recording.

2. Related Art

Following description illustrates an ink jet printer as one example of a recording apparatus. The ink jet printer has a recording head module with a number of fine nozzle orifices provided therein. Ink droplets are ejected from the nozzle orifices when the ink jet printer performs recording, unavoidably involving a problem of clogging of each nozzle orifice. Especially, a line printer has a fixed recording head module with a numerous number of nozzle orifices arrayed over the entire length of the line of recording. Likewise, an industrial ink jet printer has tens of recording head modules with a numerous number of nozzle orifices arranged therein. When clogging leading to a failure of the ejection of the ink droplet happens, a white streak appears on the surface of a recording material carrying the recorded image, impairing the quality of recording.

Accordingly, a typical ink jet printer has a droplet-ejection detecting device provided therein which determines whether the ink droplets are safely ejected from the nozzle orifices of the recording head module. However, such a known droplet-ejection detecting device is configured to slowly move a recording head module with a plurality of nozzle orifices across a light path between a fixed laser-emitting source and a fixed light-receiving unit, so as to check each of the nozzle orifices one by one, as shown in JP-A-11-179884. Also, another droplet-ejection detecting device has electrodes arranged to receive electrostatically charged ink droplets to determine the state of ejection of the ink droplets by detecting the change in voltage of the electrode.

These known devices inconveniently take a few seconds per 1000 nozzle orifices to detect the ejections of the droplets from the nozzle orifices. Additionally, the device relying upon the voltage change is usable only on limited ink compositions.

SUMMARY

An advantage of some aspects of the invention is to provide a droplet-ejection detecting device, as well as a recording apparatus incorporating the droplet-ejection detecting device, which is able to quickly determine whether a droplet is ejected safely from a droplet ejecting head module having a plurality of nozzle orifices. The droplet-ejection detecting device is usable not only for movable droplet ejecting head modules but also for stationary droplet ejecting head modules.

A droplet-ejection detecting device according to a first aspect of the invention for detecting ejection of droplets from a plurality of nozzle orifices includes: a beam scanning mechanism which scans a plurality of droplet ejection lines along which droplets ejected from the nozzle orifices fly, by emitting a beam to intersect the droplet ejection lines, thereby subjecting the droplets to irradiation with the beam; a light receiving unit which receives light obtained as a result of the irradiation; and an ejection determining mechanism which determines safe ejections of the droplets from the nozzle orifices based on a received-light signal output from the light receiving unit. Here, the droplet ejection lines are virtual lines corresponding to flight paths along which the ink droplets ejected from the nozzle orifices fly.

According to the first aspect of the invention, the beam scanning mechanism emits the beam so as to intersect all droplet ejection lines, thereby determining quickly and accurately whether the droplets are ejected from the nozzle orifices safely. The invention can be operable not only with a movable droplet ejecting head module but also with a stationary droplet ejecting head module since the droplet ejecting head module does not need to be moved.

The droplet-ejection detecting device of the first aspect may be configured such that the scanning is executed over a plurality of cycles in each of which the timing of the scanning and the timing of the ejection of the droplets are controlled in a timed relation to each other, the timed relation being varied between successive scanning cycles, and the ejection determining mechanism determines safe ejections of the droplets from the nozzle orifices based on received-light signals obtained by the plurality of cycles of scanning.

When using the device in which the droplets are ejected from a number of nozzle orifices and the droplets flying along the droplet ejection lines are subjected to irradiation with the beam intersecting the ejection lines, it might be possible to achieve alignment between the beam position and the droplet positions by a single scanning cycle, provided that an optimal combination is obtained between the scanning speed, the beam diameter, the droplet diameter and the droplet ejection velocity. However, such an optimal combination is hardly obtainable.

With the above-described configuration, the scanning is executed over the plurality of cycles in each of which the timing of the scanning and the timing of the ejection of the droplets are controlled in the timed relation to each other, the timed relation is varied between successive scanning cycles, and the ejection determining mechanism determines safe ejections of the droplets from the nozzle orifices based on received-light signals obtained by the plurality of cycles of scanning. Therefore, with this configuration, the relative position (distance) between the laser beam and the ink droplet on the associated droplet ejection line changes in successive scanning cycles.

Some spots on the droplet ejection lines encountered by the momentary laser beam paths may fail to entirely or partially align with corresponding ink droplets. However, performing the successive scanning cycles with the varying timed relation enables all these spots to align at least once with the ink droplets during the successive scanning cycles. By performing plural scanning cycles and combining results obtained from the plurality of scanning cycles, it is possible to appropriately determine the state of ejection of the droplets, while addressing the foregoing problem of alignment failure.

In other words, in addition to the foregoing advantages, the above-described configuration offers another advantage in that aligning the beam with all droplets is achieved by executing scanning over the plurality of cycles in the timed relation with the ejection of the droplets, whereby appropriate determination of the safe ejection of the droplets is realized.

The droplet-ejection detecting device may include a scanning commencement detector which detects a scanning commencement timing at which the scanning is commenced, and a controller which delays the ejection timing for a predetermined amount of delay time from the scanning commencement timing, the predetermined amount of delay time being varied between the successive scanning cycles, thereby varying the timed relation between successive scanning cycles.

With this arrangement, the scanning commencement timing is detected by the scanning commencement detector and the ejection timing is delayed a predetermined amount of time from the scanning commencement timing for each scanning cycle, and the amount of delay is varied between the successive scanning cycles so that the timed relation between the successive scanning cycles varies. Therefore, the variation of the timed relation is easily achieved with a simple controlling mechanism utilizing the delay time as one factor.

The droplet ejection detecting device may also be configured such that the light receiving unit receives reflected light as the result of the irradiation, the reflected light being generated by subjecting the droplets to the irradiation with the beam, the droplets flying along the droplet ejection lines. Here, the word "reflected light" is used in a meaning including scattered light as well as the literal "reflected light" reflected backward from the droplets subjected to the irradiation with the beam.

This arrangement offers, in addition to the advantages described in the foregoing, an additional advantage as follows. Namely, since the light receiving unit receives the reflected light, the light receiving unit need not be arranged to directly face the beam scanning mechanism, thereby allowing greater versatility in designing.

The droplet ejection detecting device may also be configured such that the light receiving unit is located facing the beam scanning mechanism across the droplet ejection lines, so as to receive a passing light which reaches the light receiving unit without being blocked by a droplet when the scanning is performed over the droplet ejection lines along which the droplets fly.

With this arrangement, because the passing light which is not blocked by the droplets is directly received by the light receiving unit, it is possible to employ a simple structured unit as the light receiving unit, thus offering an additional advantage besides the advantages described hereinbefore.

The light receiving unit may has, for example, a light receiving element and other components. When the droplet ejection detecting device relies upon the reflected light, at least the light receiving element may be located in neighborhood of the beam scanning mechanism.

With this arrangement, at least the light receiving element of the light receiving unit is located in the neighborhood of the beam scanning mechanism, so that the light receiving element and the beam scanning mechanism can be unified as a single unit. This eliminates the necessity of any troublesome adjustment of the light paths which otherwise may be necessary to achieve optical alignment between the light receiving element and the beam scanning mechanism.

Also, it is possible to provide a cover member which covers the light receiving element and the beam scanning mechanism together as one unit, so that spattering droplets are prevented from attaching to the light receiving element and the beam scanning mechanism.

The beam scanning mechanism may include a beam emitting source which emits the beam and a scanning mirror which changes a traveling direction of the beam emitted from the beam emitting source.

With this arrangement, it is possible to change the traveling direction of the laser beam by using the scanning mirror, so that the plurality of the droplet ejection lines are subjected to the irradiation with the laser beam which is emitted from the single beam emitting source (laser-emitting source) and which traverses past the various momentary laser beam paths, thus offering another advantage in addition to the foregoing advantages.

According to a second aspect of the invention, a recording device includes a record performing unit having a recording head module with a plurality of nozzle orifices; and a droplet-ejection detecting device which detects ejections from the plurality of nozzle orifices, the droplet-ejection detecting device being the droplet-ejection detecting device according to the first aspect of the invention.

According to this aspect of the invention, it is possible to achieve the same advantages as those offered by any of the droplet-ejection detecting device of the first aspect of the invention in the ink jet printer having the recording head module with the plurality of nozzle orifices. It is therefore possible to prevent or suppress generation of white streaks which tend to appear in the recorded image due to, for example, clogging of a nozzle orifice, thus achieving higher recording quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

A description will now be given of a droplet-ejection detecting device according to the present invention, as well as of a recording apparatus incorporating the same.

Figure 1:
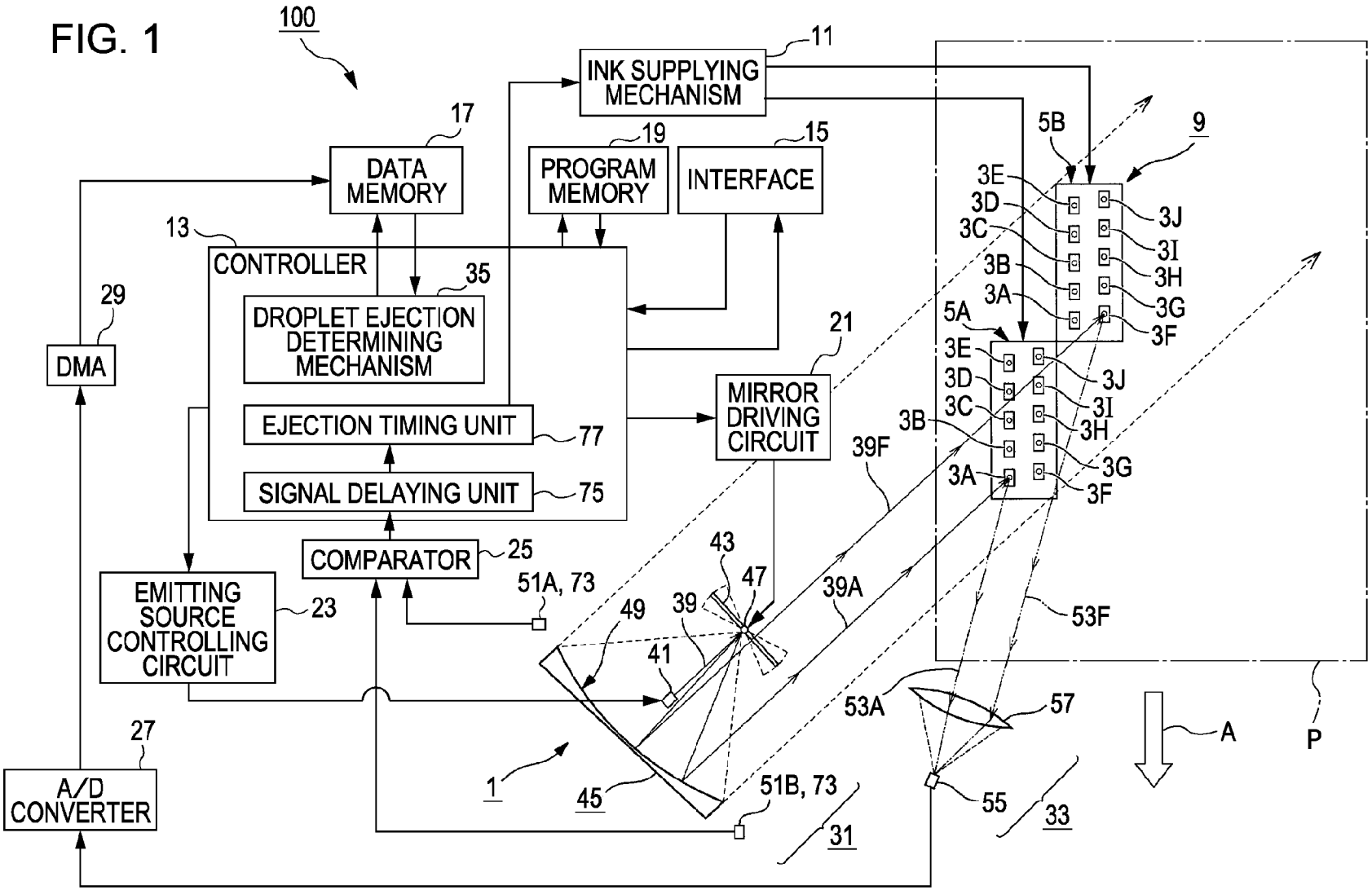
FIG. 1 is a plan view schematically illustrating a droplet-ejection detecting device according to a first embodiment.
Figure 2:
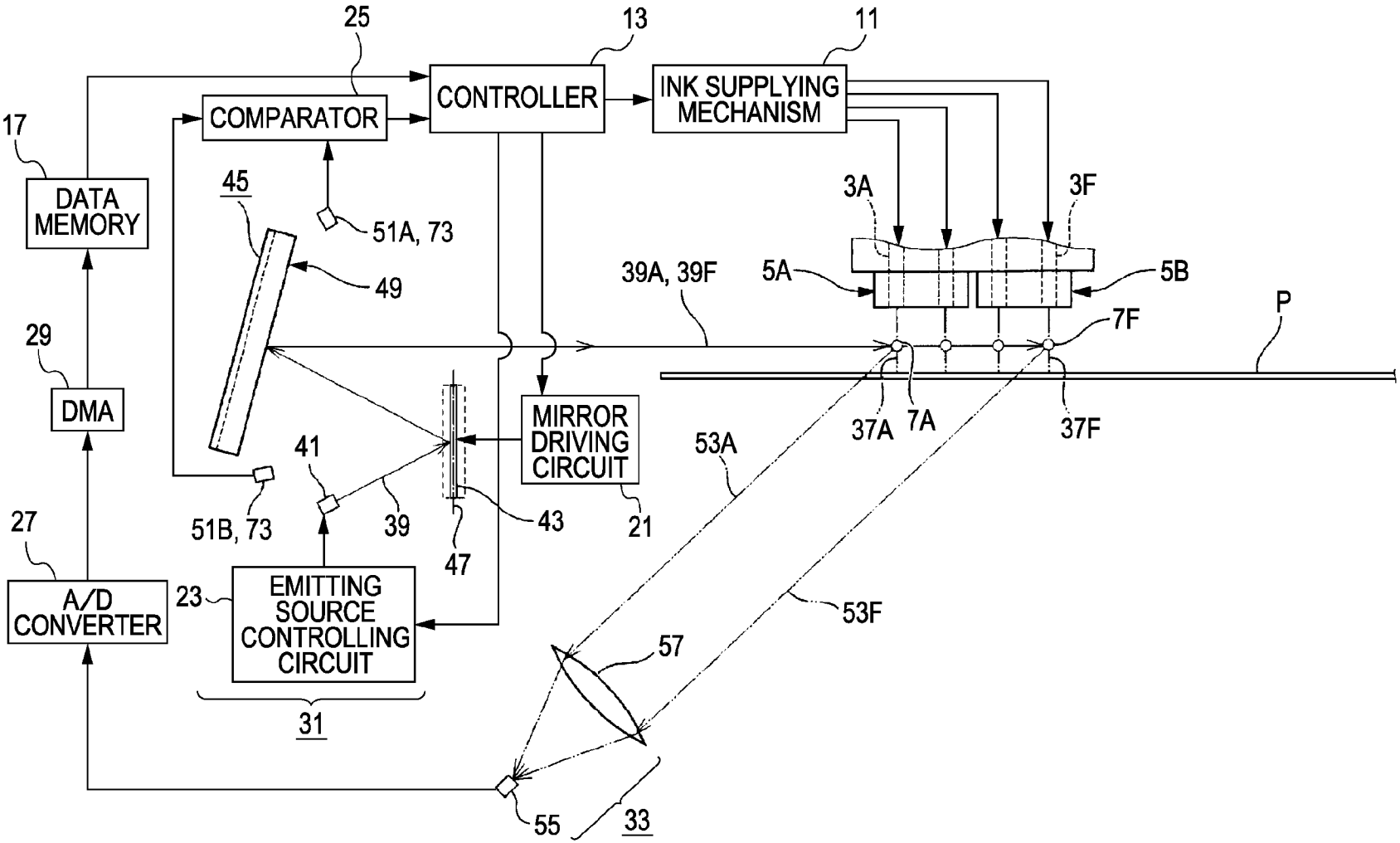
FIG. 2 is a side view schematically illustrating the droplet-ejection detecting device according to the first embodiment.

Referring first to FIGS. 1 and 2, an entire structure of an ink jet printer 100 is schematically described as a best mode for carrying out the recording apparatus according to the present invention. The ink jet printer 100 has a plurality of recording head modules 5A and 5B (two recording head modules in the embodiment shown in the figures) as one example of droplet ejecting head modules having a plurality of nozzle orifices 3A to 3J (ten nozzle orifices per one module in the embodiment shown in the figures) provided therein. The ink jet printer 100 performs recording by ejecting ink droplets 7A to 7J as one example of droplets onto a surface of a recording material (hereinafter referred also to as "sheet") P.

The ink jet printer 100 has a transporting mechanism (not shown) which holds the sheet P inside of a printer main body and transports the sheet P and a record performing unit 9 which performs recording on the recording surface of the sheet P held and transported by the transporting mechanism provided therein. The transporting mechanism may employ, for example, a belt-transporting unit with an endless belt, or a roller-transporting unit with pairs of opposing nip rollers arranged adjacent to one another in a sheet transporting direction.

Meanwhile, the record performing unit 9 is configured to basically have aforementioned two recording head modules 5A and 5B, each of the head modules having ten nozzle orifices 3A to 3J, an ink supplying mechanism 11 supplying ink individually to the twenty, in total, nozzle orifices 3A to 3J, and a controller 13 performing various kinds of controls.

The controller may have built-in components such as an interface 15, a data memory 17, a program memory 19, a mirror driving circuit 21, a laser-emitting source controlling circuit 23, a comparator 25, an A/D converter 27 and a direct memory access (hereinafter referred to as "DMA") 29. Alternatively, these components may be separately provided and individually connected to the controller 13, as shown in block diagrams of FIGS. 1 and 5.

First Embodiment

Next, the droplet-ejection detecting device 1 according to the present invention employed in the ink jet printer 100 configured in a manner illustrated in the foregoing is described in detail with reference to drawings.

Figure 3:
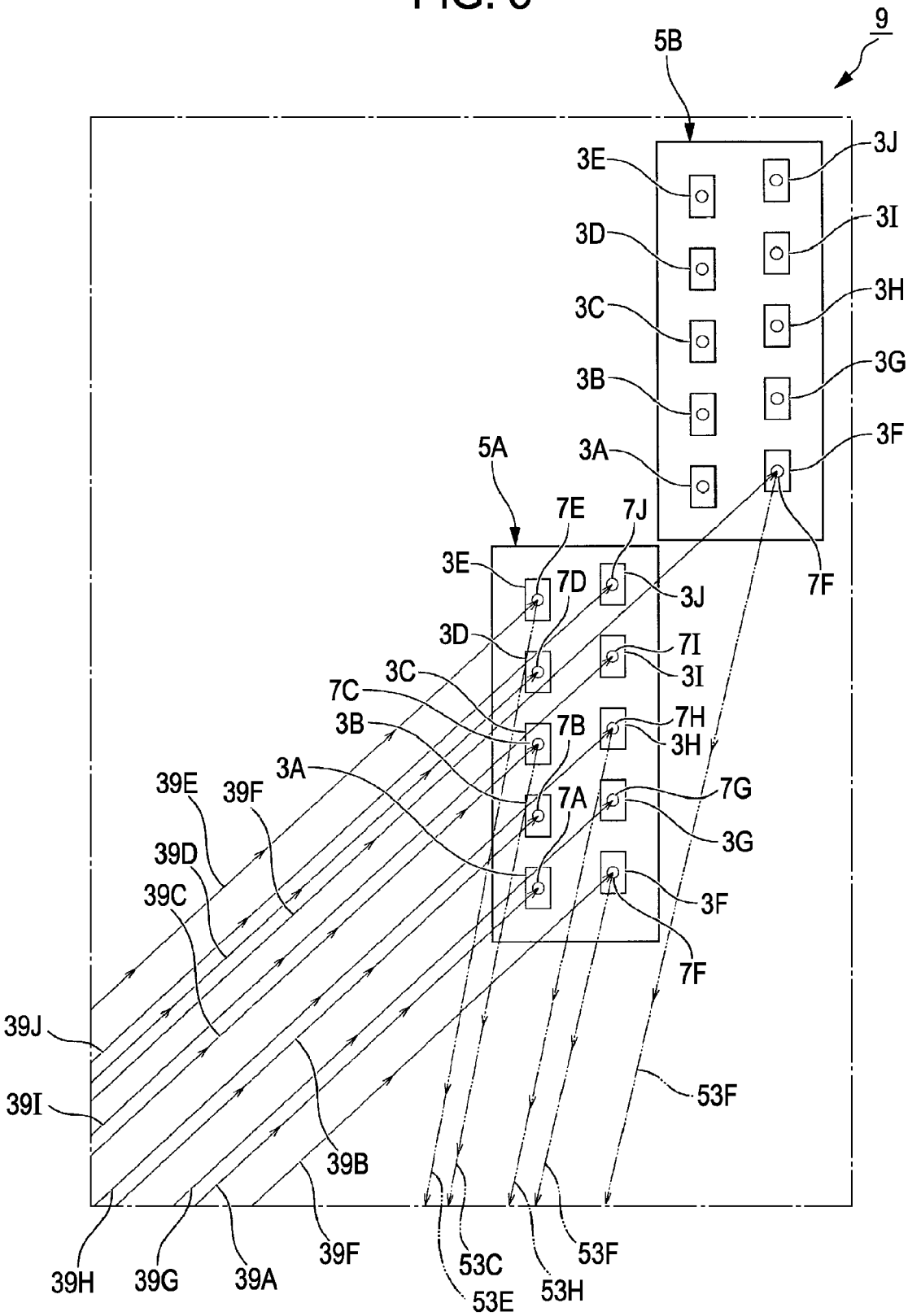
FIG. 3 shows in a greater scale the recording head modules of the same device together with an arrangement therearound.
Figure 4:
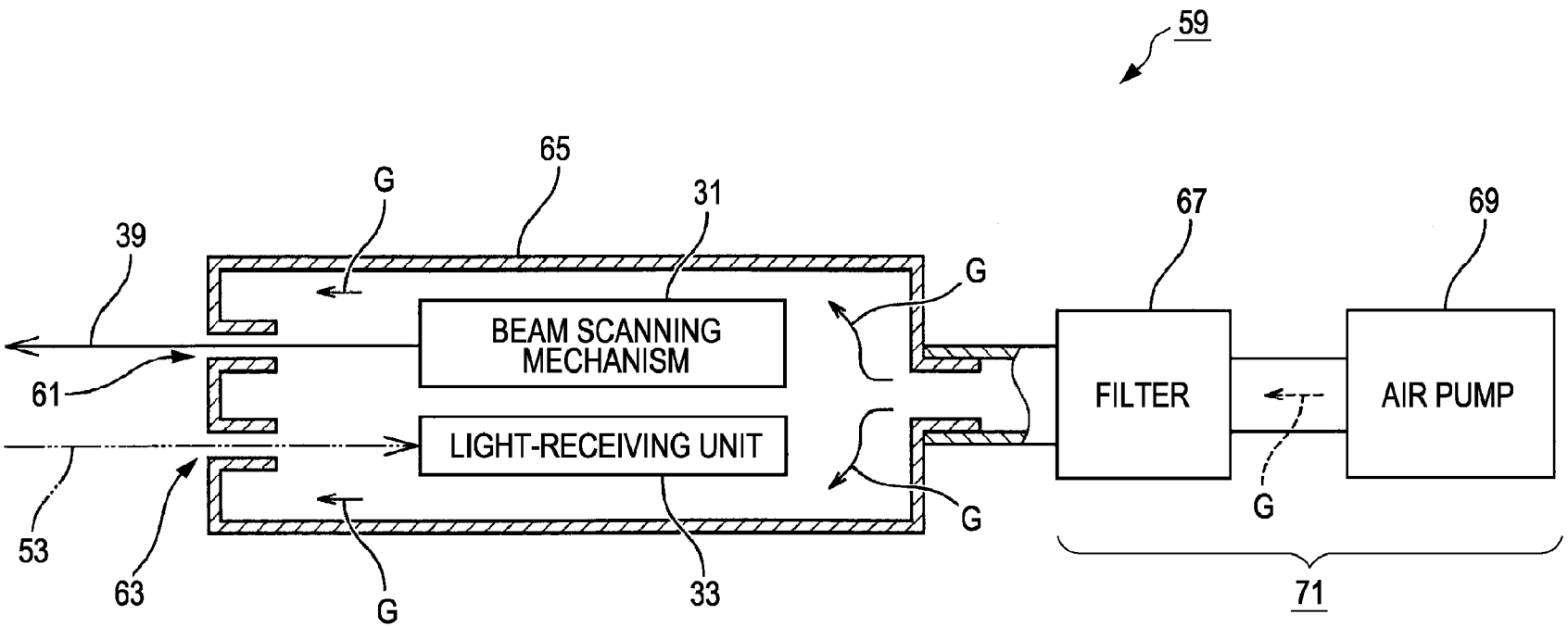
FIG. 4 is a side view schematically illustrating a cover structure.
Figure 5:
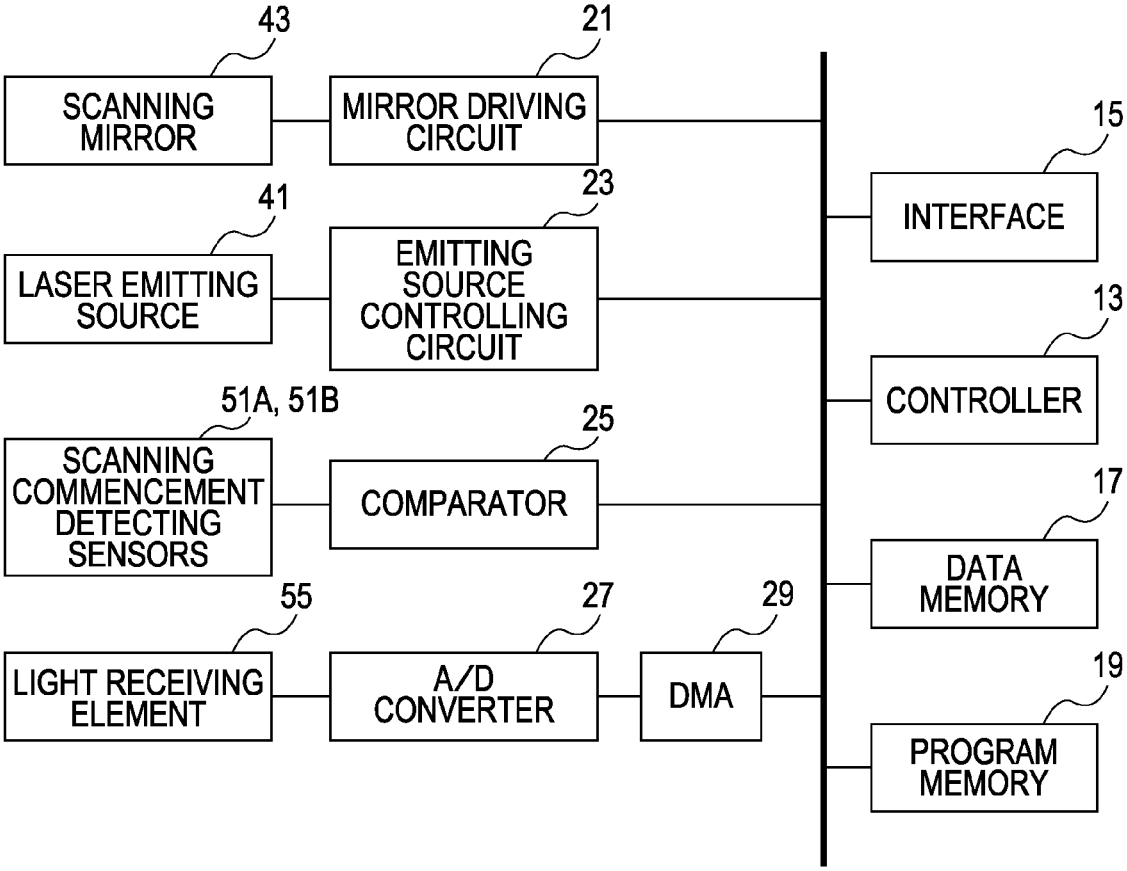
FIG. 5 is a block diagram showing detecting-and-controlling elements of the droplet-ejection detecting device.

FIG. 1 is a plan view schematically illustrating a droplet-ejection detecting device according to a first embodiment, FIG. 2 is a side view of the same device, and FIG. 3 shows in a greater scale the recording head modules of the same device together with an arrangement therearound. FIG. 4 is a side view schematically illustrating a cover structure applied to a beam scanning (sweep/irradiation) mechanism and a light-receiving unit. FIG. 5 is a block diagram showing a relation between controlling elements interconnecting detectors of each units of the droplet-ejection detecting device to the controller.

Figure 6:
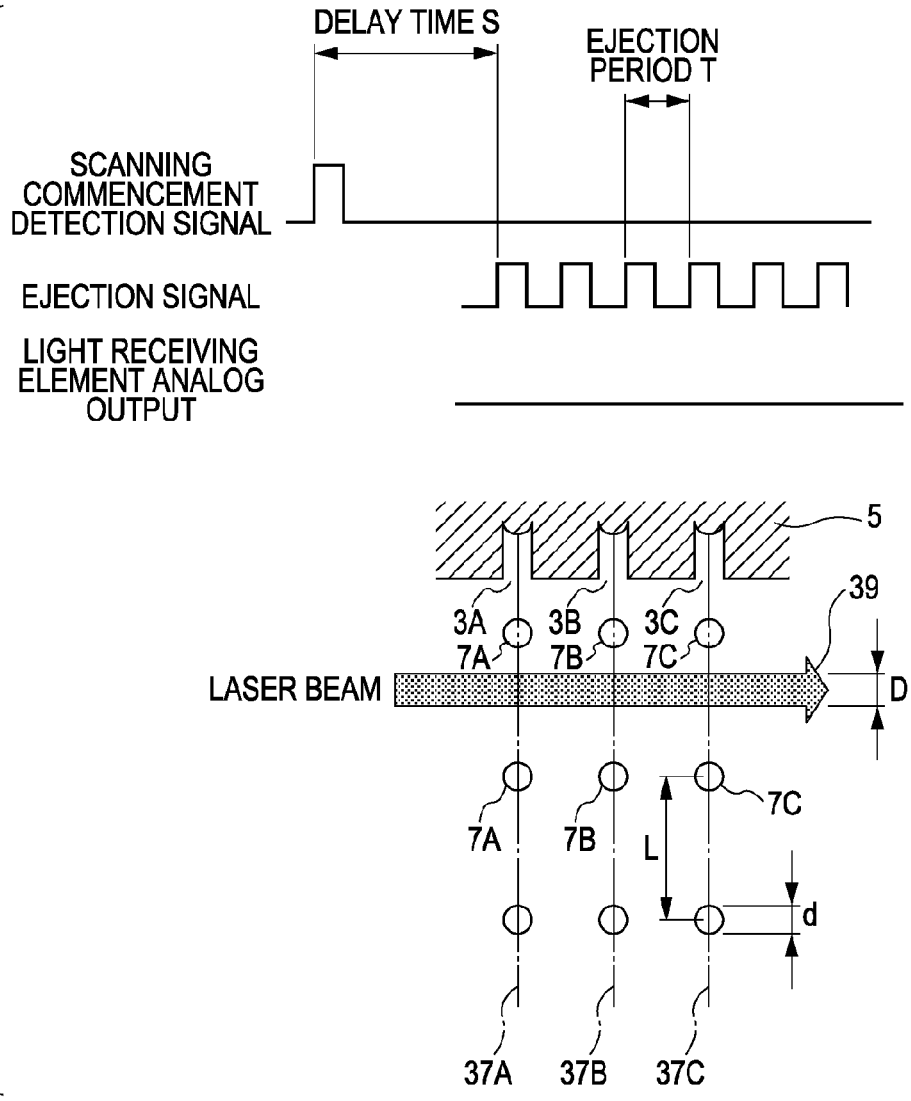
FIG. 6 is an illustration of a relation between a delay time and a irradiation state when the delay time is S.
Figure 7:
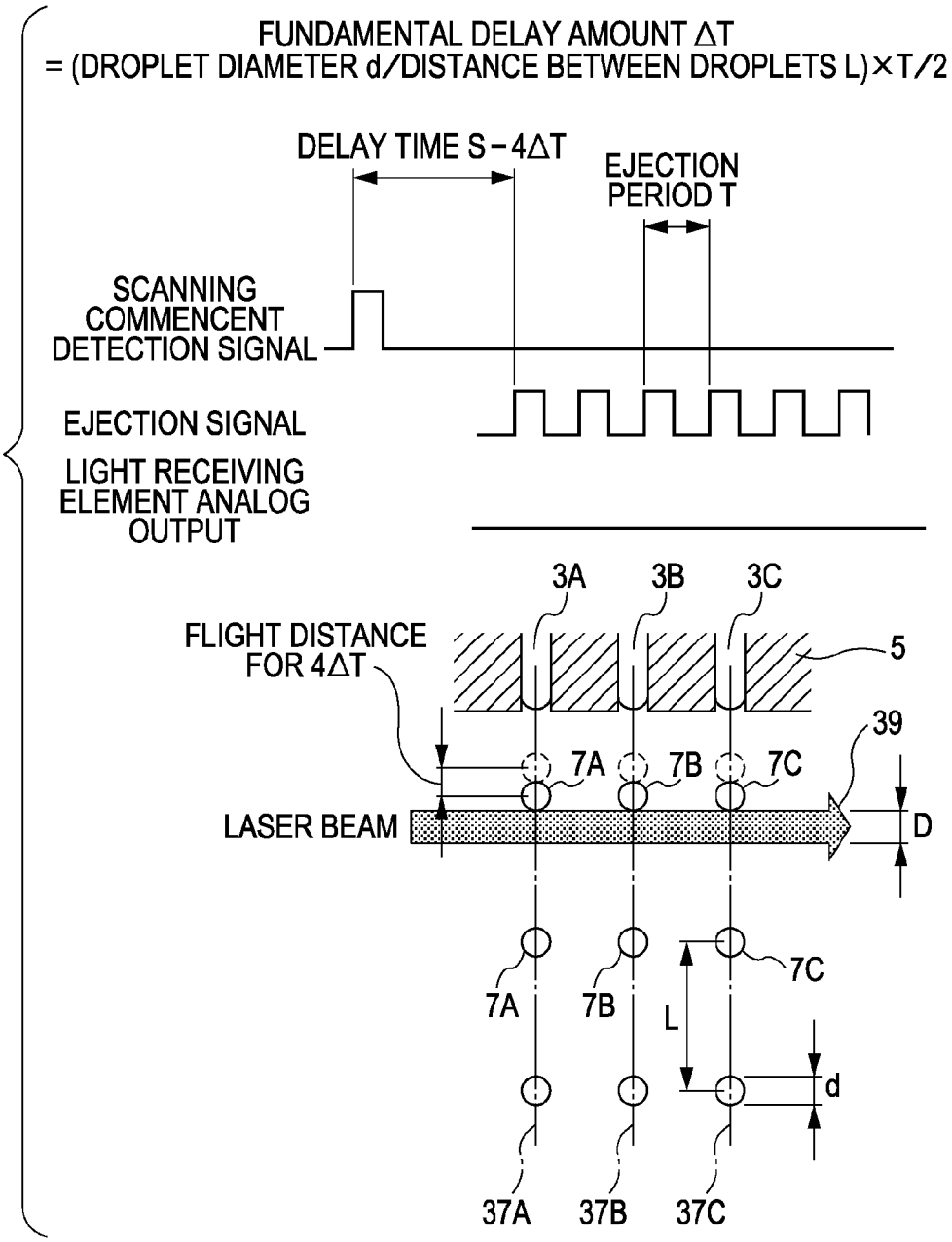
FIG. 7 is an illustration of a relation between the delay time and the irradiation state when the delay time is $S-4\Delta T$.
Figure 8:
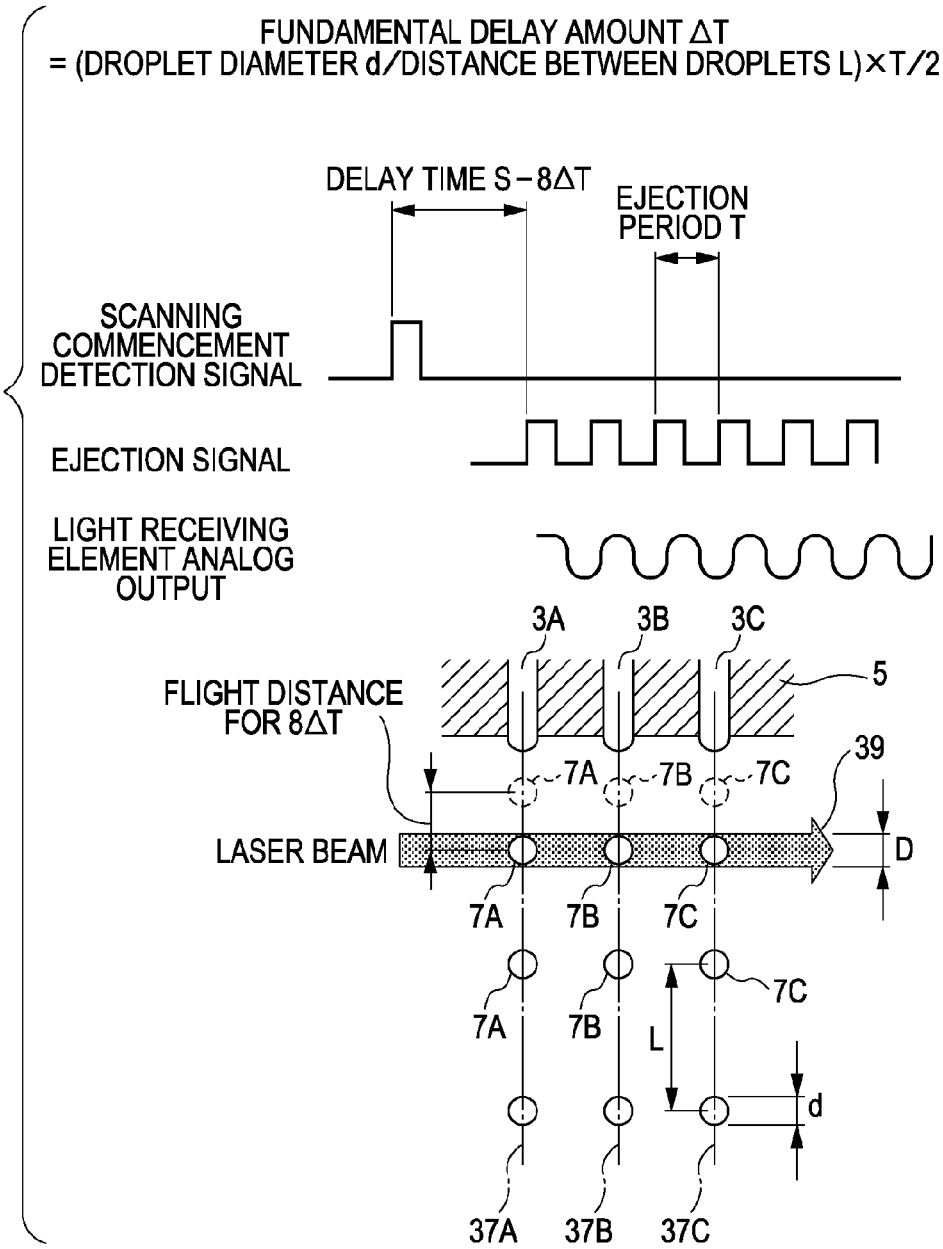
FIG. 8 is an illustration of a relation between the delay time and the irradiation state when the delay time is $S-8\Delta T$.
Figure 9:
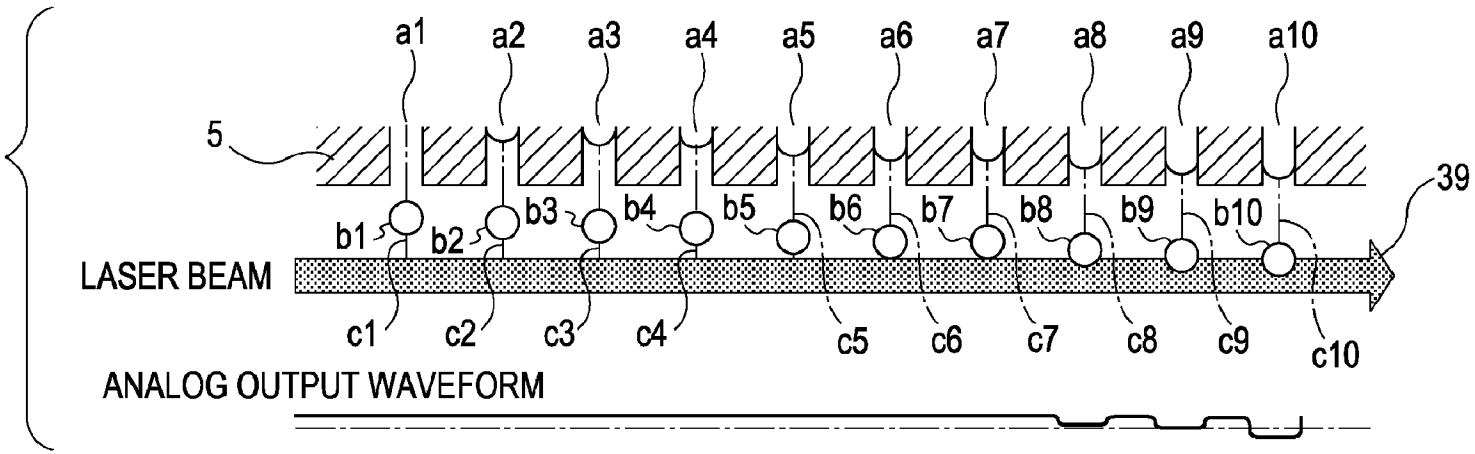
FIG. 9 is an illustration of a relation between the irradiation state and a received-light output at the first scanning cycle when nozzle orifices are not clogged.
Figure 10:
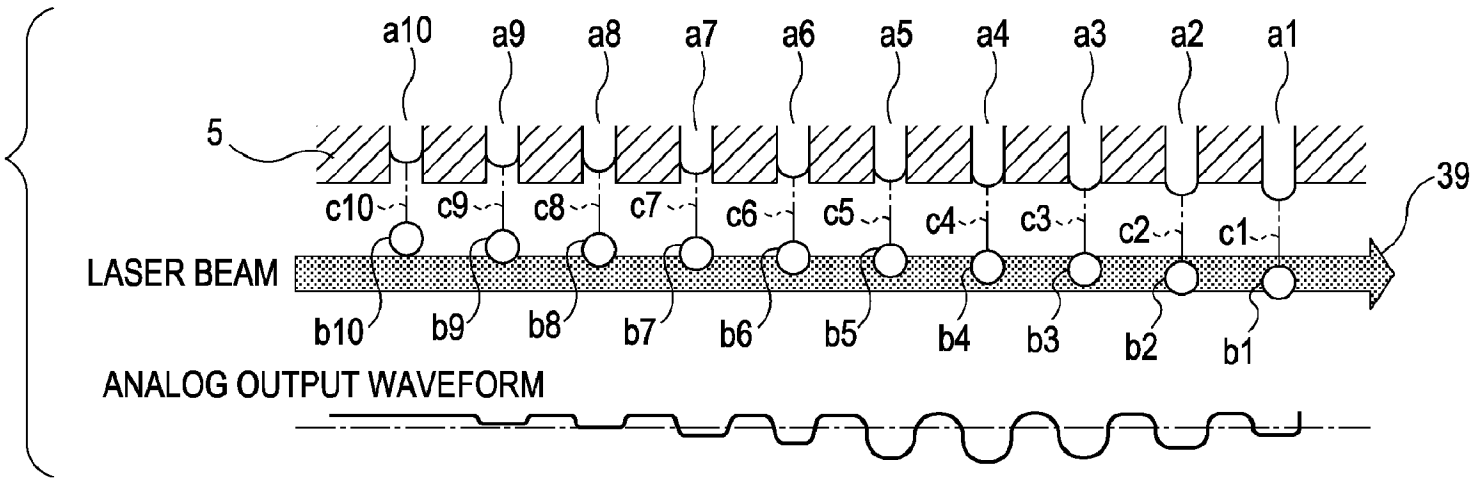
FIG. 10 is an illustration of a relation between the irradiation state and the received-light output at the second scanning cycle when the nozzle orifices are not clogged.
Figure 11:
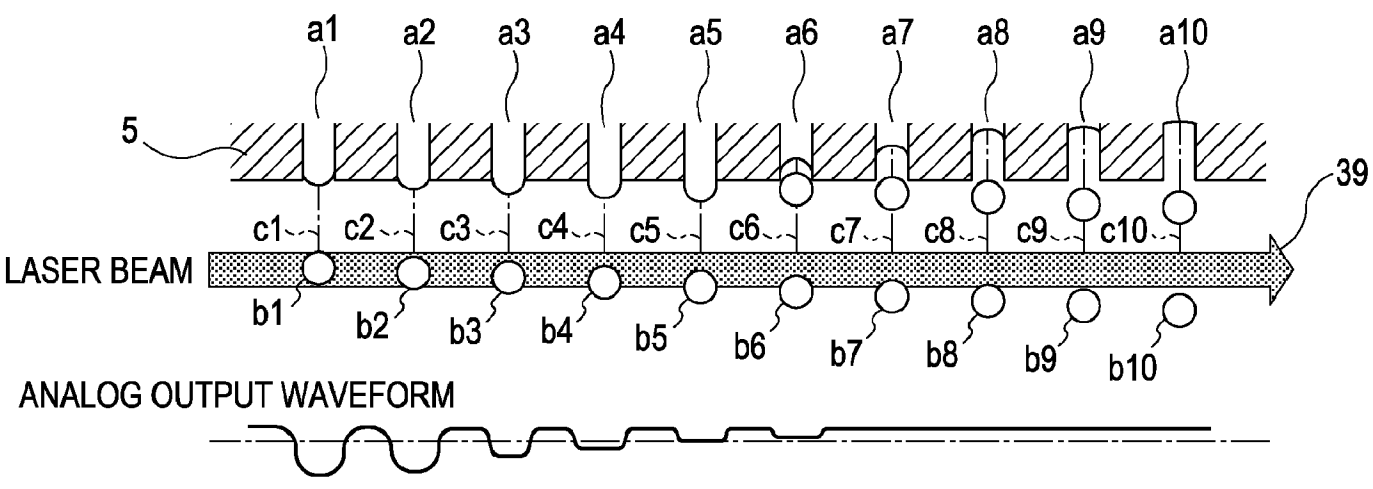
FIG. 11 is an illustration of a relation between the irradiation state and the received-light output at the third scanning cycle when the nozzle orifices are not clogged.
Figure 12:
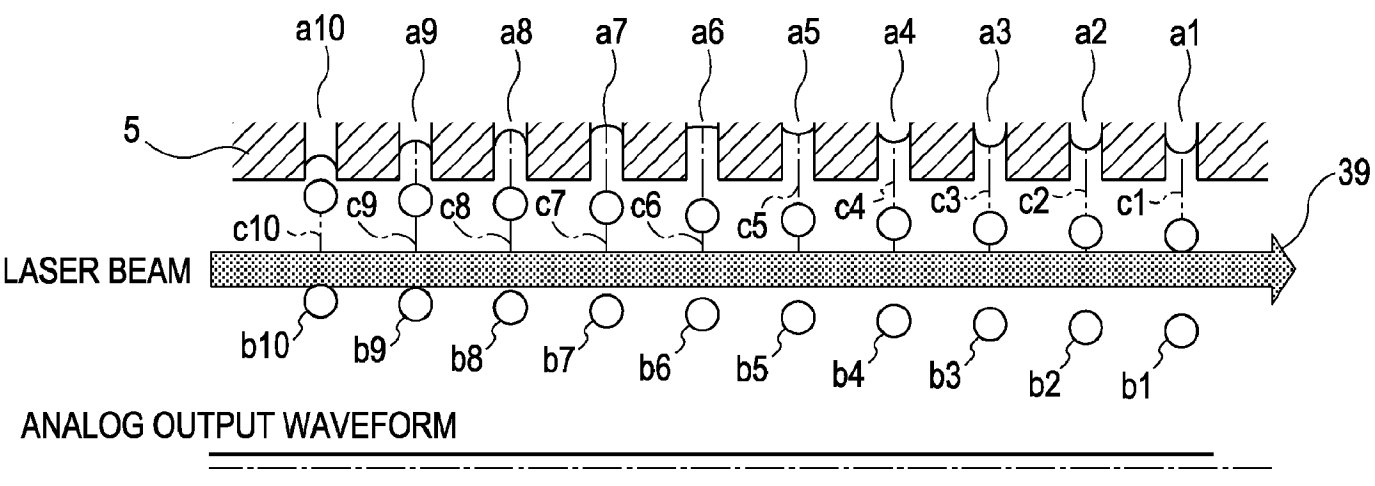
FIG. 12 is an illustration of a relation between the irradiation state and the received-light output at the fourth scanning cycle when the nozzle orifices are not clogged.
Figure 13:
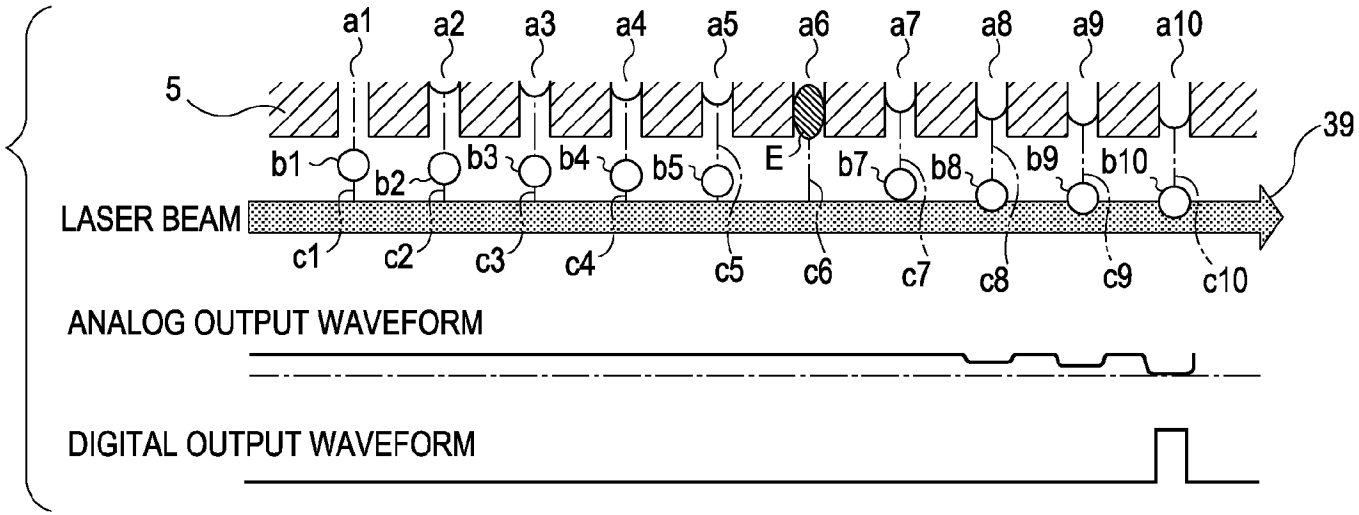
FIG. 13 is an illustration of a relation between the irradiation state and the received-light output at the first scanning cycle when a nozzle orifice is clogged.
Figure 14:
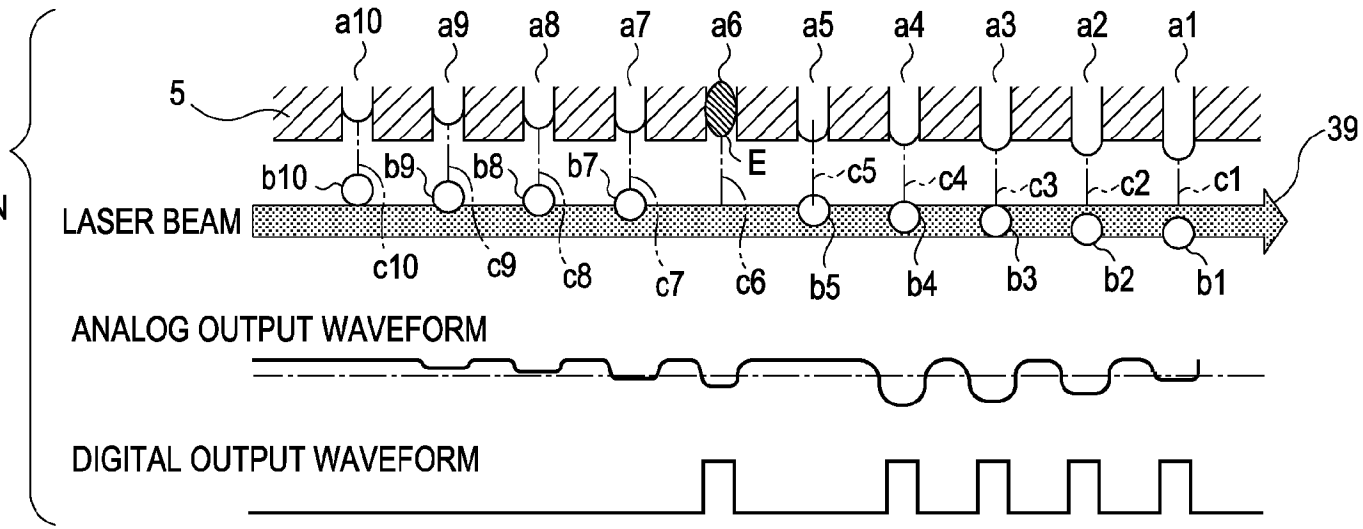
FIG. 14 is an illustration of a relation between the irradiation state and the received-light output at the second scanning cycle when the nozzle orifice is clogged.
Figure 15:
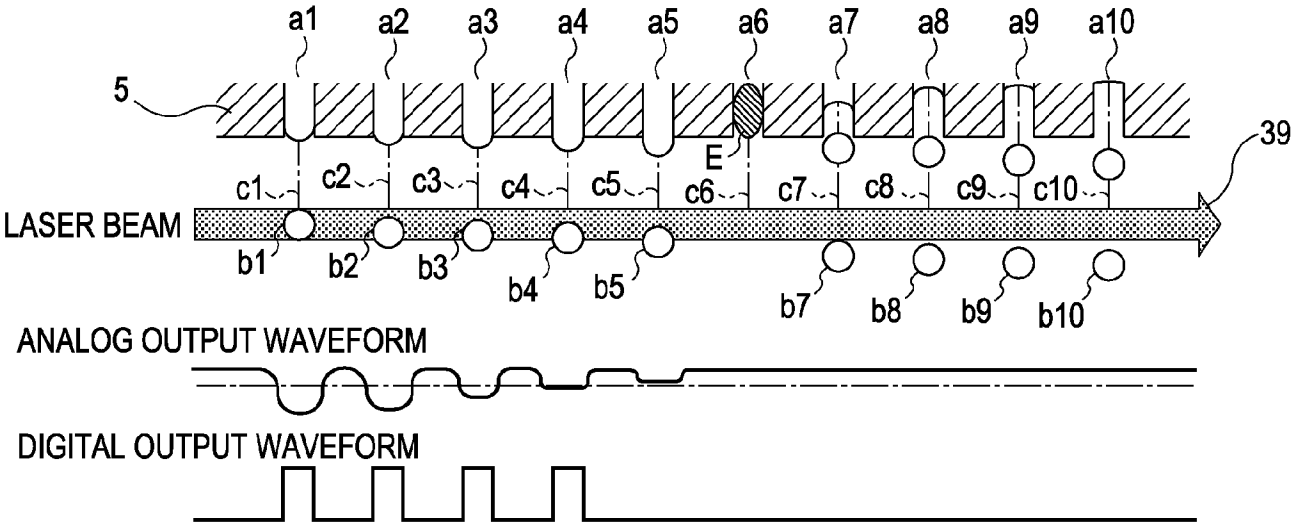
FIG. 15 is an illustration of a relation between the irradiation state and the received-light output at the third scanning cycle when the nozzle orifice is clogged.
Figure 16:
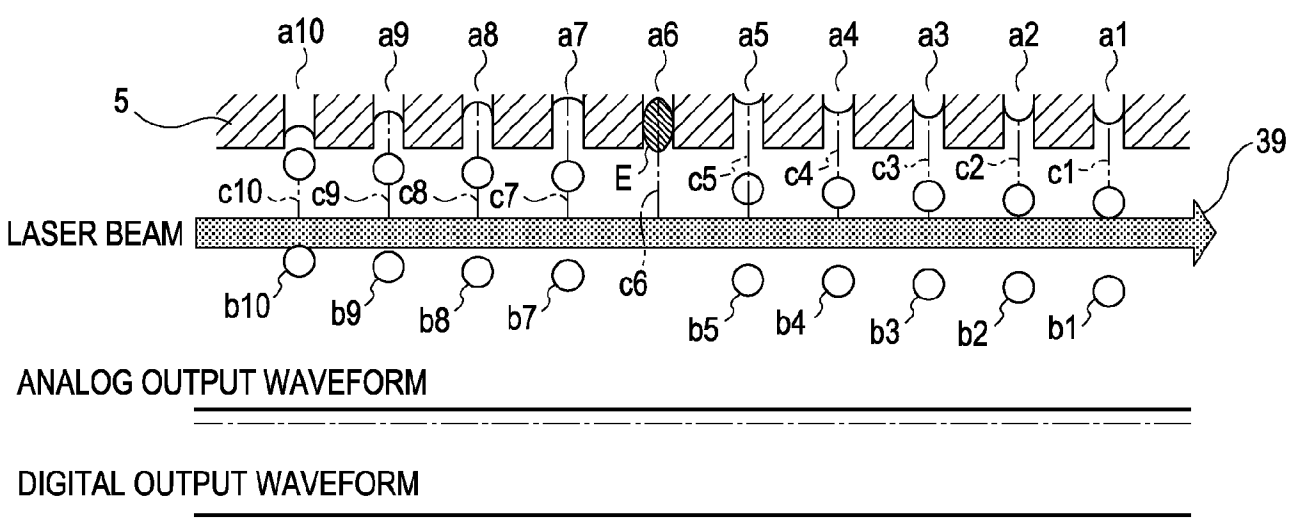
FIG. 16 is an illustration of a relation between the irradiation state and the received-light output at the fourth scanning cycle when the nozzle orifice is clogged.

FIGS. 6 to 8 are illustrations of relations between delay time and irradiation state. The delay time is a time period between a timing when a scanning commencement detecting signal is detected and a timing when a droplets ejection signal is output. FIGS. 6, 7, and 8 show the relations when the delay time is S, S−4ΔT and S−8ΔT, respectively. FIGS. 9 to 12 are illustrations of relations between irradiation states and analog output waveforms of received-light signals when the nozzle orifices are not clogged, comparing each of four cycles of sweep/irradiation (scanning) varying in the delay time. FIGS. 9, 10, 11 and 12 show the above relations at the first scanning cycle, second scanning cycle, third scanning and the fourth scanning, respectively.

Figure 17:
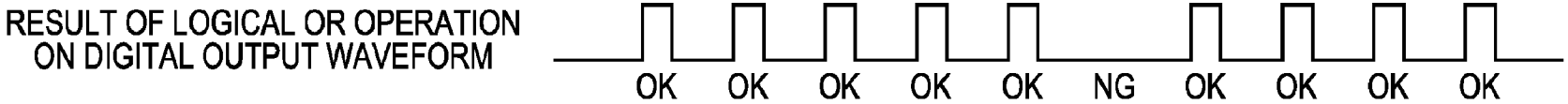
FIG. 17 is an illustration of a final detecting result of the received-light output.

FIGS. 13 to 16 are illustrations of relations among irradiation states, analog output waveforms of light-received signals and digital output waveforms of the light-received signals generated by having the analog output waveforms A/D converted, as obtained when one of the nozzle orifices is clogged, comparing each of four cycles of scanning varying in the delay time. FIGS. 13, 14, 15 and 16 show the above relations at the first, second, third and fourth scanning cycles, respectively. FIG. 17 is an illustration of a final detecting result in a digital output waveform of the received-light signal, the result being obtained through the logical OR operation on the results of above mentioned four cycles of scanning when the nozzle orifice is clogged.

The droplet-ejection detecting device 1 according to the present invention basically has, in addition to the beam scanning mechanism denoted by 31 and the light-receiving unit denoted by 33, a droplet ejection determining mechanism 35 as shown in FIGS. 1 to 3. A laser beam is preferably but not exclusively used as a beam in this embodiment.

The beam scanning mechanism 31 scans a plurality of droplet ejection lines 37A to 37J along which droplets ejected from the plurality of nozzle orifices 3A to 3J fly, by emitting a beam at an angle to the droplet ejection lines, thereby subjecting the droplets to irradiation with the beam. The droplet ejection lines 37A to 37J are irradiated with the laser beam 39 sequentially one by one. Here, each of momentary laser beam paths 39A to 39J in the figures indicates light paths of the laser beam 39 at different timings. More specifically, the beam scanning mechanism 31 has a laser-emitting source 41 for emitting the laser beam 39 and an oscillating scanning mirror 43 for varying the traveling direction of the laser beam 39. The scanning mirror 43 reflects the laser beam 39 in varying directions to allow the laser beam 39 traverse past the momentary laser beam paths 39A to 39J. A laser-path changing mirror 45 is provided in this embodiment. The laser-path changing mirror 45 reflects the laser beam 39 impinging thereon in a single direction in such manner that the reflected laser beam 39 continuously travels along momentary parallel laser beam paths 39A to 39J intersecting with the droplet ejection lines 37A to 37J, respectively.

A laser diode may be used as the laser-emitting source 41. The laser-emitting source 41 is controlled by the laser-emitting source controlling circuit 23. The laser beam 39 of a certain beam diameter D is emitted toward the scanning mirror 43. The scanning mirror 43 includes a resonant mirror as one example. The mirror driving circuit 21 oscillates the scanning mirror 43 over a certain angle about an oscillating axis 47 serving as a center of oscillation. A polygon mirror or a galvanometer mirror may also be used as the scanning mirror 43.

The laser-path changing mirror 45 includes a concaved mirror as one example. The focal point of the concaved mirror is located at the point where the laser beam is reflected on the scanning mirror 43 (the center of oscillation on the reflecting surface of the scanning mirror 43). Therefore, the laser beam 39 being incident on the concaved surface 49 of the laser-path changing mirror 45 is reflected on the concaved surface 49 so as to traverse past the momentary parallel laser beam paths 39A to 39J intersecting with the droplet ejection lines 37A to 37J corresponding to the nozzle orifices 3A to 3J, respectively. Thus, the droplet ejection lines 37A to 37J are irradiated with the laser beam 39 one by one. Scanning commencement detecting sensors 51A and 51B are provided near both end extremities of the laser-path changing mirror 45. The scanning commencement detecting sensors 51A and 51B form a scanning commencement detector 73 which detects commencement of the scanning by the laser beam 39.

The commencement of the scanning of the laser beam 39, i.e. a scanning commencement timing, detected by the scanning commencement detector 73, and an ejection timing of the ink droplets 7A to 7J from the nozzle orifices 3A to 3J are controlled in a timed relation to each other. In addition, the scanning is performed a plurality of number of cycles, and the timed relation is varied between the successive scanning cycles.

The ejections of the ink droplets from the nozzle orifices 3A to 3J is detected during the plurality of scanning cycles. More specifically, a spot on the droplet ejection lines 37A to 37J, with which the momentary laser beam paths 39A to 39J intersect, and an actual positions of the respective ink droplets 7A to 7J ejected from the nozzle orifices 3A to 3J differ between the successive scanning cycles. In other words, a relative position (distance) between the laser beam and the ink droplet on the associated droplet ejection line changes in the successive scanning cycles.

In a single scanning cycle, some spots on the droplet ejection lines 37A to 37J encountered by the momentary laser beam paths 39A to 39J may fail to entirely or partially align with corresponding ink droplets 7A to 7J. However, performing the successive scanning cycles with the varying timed relation enables all these spots to align at least once with the ink droplets during the successive scanning cycles. By performing plural scanning cycles and combining results obtained from the plurality of scanning cycles, it is possible to appropriately determine the state of ejection of the droplets, while addressing the foregoing problem of alignment failure.

The plurality of scanning cycles with the varying timed relations are achieved by using the following structure.

Referring again to FIG. 1, the controller 13 is operative to implement delays of the ejection timing for predetermined amount of delay time from the scanning commencement timing detected by the scanning commencement detector 73. Namely, the amount of delay time is varied between the successive scanning cycles, thereby varying the timed relation between the successive scanning cycles. The controller 13 has a signal delaying unit 75 and an ejection timing unit 77.

The signal delaying unit 75 delays the ejection timing for the predetermined amount of delay time from the scanning commencement timing detected by the scanning commencement detecting sensors 51A and 51B for each scanning cycle. More specifically, the signal delaying unit 75 outputs an ejection commencement trigger signal which is delayed a predetermined amount of time from the scanning commencement timing for each scanning cycle, and the amount of delay is varied between the successive scanning cycle. The ejection timing unit 77 produces a droplet ejection signal in synchronization with the ejection commencement trigger signal, whereby ink droplets 7A to 7J are ejected simultaneously from all the nozzle orifices 3A to 3J.

Operations of the scanning commencement detector 73, the signal delaying unit 75 and the ejection timing unit 77 will be described later in connection with droplets ejection detecting operation.

The light-receiving unit 33 has a light receiving element 55 which receives reflected leaser beam 53, the momentary paths of which being indicated at 53A to 53J, reflected on the ink droplets 7A to 7J flying along the droplet ejection lines 37A to 37J. The light-receiving unit also has a light path adjusting lens 57 which has, as one example, a convex lens converging the reflected leaser beam so that the beam 53 traveling along paths including momentary reflected-laser-beam paths 53A to 53J is focused on the light receiving element 55. Here, each of the momentary reflected-laser-beam paths 53A to 53J in the figures indicates a light path of the reflected laser beam at various timings.

The light-receiving unit 33 is provided adjacent to the beam scanning mechanism 31 as schematically shown in FIG. 4. Both the light-receiving unit 33 and the beam scanning mechanism 31 are housed in a cover structure 59. The cover structure 59 has a cover member 65 having a small slit-shaped outgoing beam opening 61, through which the leaser beam 39 traveling toward to the scanning mirror 43 goes out, and a small slit-shaped entering beam opening 63, through which the reflected laser beam 53 traveling along the momentary reflected-laser-beam paths 53A to 53J to be received by the light receiving element 55 enters. The cover structure 59 also has a pressurizing mechanism 71 having a filter 67 and an air pump 69 which in cooperation maintains an elevated pressure of clean air G inside the cover member 65.

The droplet ejection determining mechanism 35 is built in the controller 13, being used for detecting the ejection of the ink droplets 7A to 7J from the nozzle orifices 3A to 3J based on a received-light signal output from the light-receiving unit 33. The received-light signal output from the light-receiving unit 33, which is an analog-data signal, is converted into a digital-data signal by the A/D converter 27, and stored in the data memory 17 through the DMA 29. The droplet ejection determining mechanism 35 reads all digital data stored in the data memory 17, the all digital data being obtained during the plural scanning cycles. The logical OR operation is applied to each of the all digital data to determine whether ink droplets 7A to 7J are ejected or not. The detail of the droplet ejection determining mechanism 35 is described in the following description of a droplet-ejection detecting operation.

The droplet-ejection detecting operation has three steps, the operation being performed by the droplet-ejection detecting device 1 in this embodiment. These three steps are (1) a beam scanning step, (2) a light receiving step and (3) a droplets ejection determining step. These steps employing the droplet-ejection detecting device 1 according to the first embodiment will now be described.

(1) Beam Scanning Step

The beam scanning step is described with references to FIGS. 1 to 3 and FIGS. 6 to 8. The beam scanning mechanism 31 emits the laser beam 39 so that the laser beam 39 intersects with the droplet ejection lines 37A to 37J along which the ink droplets 7A to 7J fly. The laser beam 39 traverses past the momentary laser beam paths 39A to 39J which intersect with all of the droplet ejection lines 37A to 37J, respectively.

More specifically, once a command to operate the droplet-ejection detecting device 1 is issued, the controller 13 starts operating the laser-emitting source controlling circuit 23 and the mirror driving circuit 21. After the laser-emitting source controlling circuit 23 starts its operation, the beam 39 of the certain beam diameter D is emitted from the laser-emitting source 41 and travels toward the scanning mirror 43 serving as the resonant mirror. At the same time, the mirror driving circuit 21 starts operating so as to start oscillating the scanning mirror 43 about the oscillating axis 47 at a high frequency.

The commencement of the scanning of the laser beam 39 is detected by the scanning commencement detecting sensors 51A and 51B serving as the scanning commencement detector 73. The scanning commencement detection signal from the detector 73 is sent to the signal delaying unit 75 through the comparator 25. The signal delaying unit 75 output the ejection commencement trigger signal delayed from the scanning commencement detecting signal, the delay time being varied between successive scanning cycles.

FIG. 6 shows the first scanning cycle with the delay time S, FIG. 7 shows the second scanning cycle with the delay time S−4ΔT and FIG. 8 shows the third scanning cycle with the delay time S−8ΔT. In other words, FIGS. 6 to 8 illustrate the relations of the positions between the laser beam 39 and the ink droplets 7A to 7J in three cycles of scanning, the delay time varying in successive scanning cycles. As will be seen from FIG. 8, the delay time S−8ΔT provides the best matching between the scanning commencement timing and the ejection timing. FIGS. 9 to 12 and FIGS. 13 to 17 show the four cycles of scanning, details being described later.

In FIGS. 6 to 8, a symbol "L" indicates the distance between the droplets, "d" indicates droplet diameter, "D" indicates the beam diameter of the laser beam 39 and "T" indicates the period of the droplets ejection signal. Also, "ΔT" indicates fundamental delay amount and it is calculated by following formula: $\Delta T=(d/L)\times T/2$.

The ejection commencement trigger signal output by the signal delaying unit 75 is sent to the ejection timing unit 77 built in the controller 13. The ejection timing unit 77 outputs the droplets ejection signal which synchronizes all nozzle orifices 3A to 3J with the ejection commencement trigger signal so that all ink droplets 7A to 7J are ejected at the same time from the nozzle orifices 3A to 3J.

Also, the laser beam 39 being incident to the scanning mirror 43 is reflected on the scanning mirror 43, travels in the varying directions due to the high-frequency oscillation of the mirror 43 to impinge upon momentarily varying positions on the concaved surface 49 of the laser-path changing mirror 45. Then, the laser beam 39 arrived at the concaved surface 49 is reflected so that the laser beam continuously traverses past momentary parallel laser beam paths 39A to 39J intersecting with the droplet ejection lines 37A to 37J below the recording head module 5, respectively. This scanning (sweep/irradiation) of the laser beam is executed plural cycles.

(2) Light Receiving Step

The light receiving step is described with references to FIGS. 1 to 3. The light receiving unit 33 receives reflected laser beam 53 traversing past the momentary reflected-laser-beam paths 53A to 53J as the laser beam after irradiation obtained as a result of the irradiation. The laser beam 39 emitted by the beam scanning mechanism 31 travels along the momentary laser beam paths 39A to 39J as described above.

The laser beam traveling along each of the momentary laser beam paths 39A to 39J is reflected on the respective ink droplets 7A to 7J flying along the respective droplet ejection lines 37A to 37J, thereby changing the direction of traveling. By doing so, the reflected laser beam travels along the respective momentary reflected-laser-beam paths 53A to 57J toward the light path adjusting lens 57 located in the neighborhood of the beam scanning mechanism 31. The reflected laser beam 53 reaches the light path adjusting lens 57 so as to be focused. The light receiving element 55 is located at the focal point of the light path adjusting lens 57 so as to receive the reflected laser beam 53. All received-light signals received by the light receiving element 55 in the plural cycles of scanning (sweep/irradiation) are sent to the A/D converter 27 as the analog data, converted into the digital data and recorded directly on the data memory 17 by DMA 29 without entering the controller 13.

(3) Droplets Ejection Determining Step

The droplets ejection determining step is described with references to FIGS. 1 to 3, FIGS. 9 to 12 and FIGS. 13 to 17. The droplet ejection determining mechanism 35 detects the safe ejection of the ink droplets 7A to 7J from the nozzle orifices 3A to 3J, based on the received-light signals output from the light receiving unit 33.

The droplets ejection determining step is described hereafter for each case (A) when the nozzle orifices are not clogged and (B) when one or more nozzle orifices are clogged (see FIGS. 9 to 12 and FIGS. 13 to 17, respectively). Each of the nozzle orifices are denoted by a1 to a10 in an ascending order in which the laser beam 39 reaches the respective droplet ejection lines c1 to c10, in the first and third cycles of scanning in FIGS. 9 to 12. In contrast, the order in which the laser beam 39 reaches the respective droplet ejection lines is in a descending order (from c10 to c1) because they are scanned backwardly in the second and forth cycles of scanning.

(A) When the Nozzle Orifices are Not Clogged (See FIGS. 9 to 12)

The scanning is performed four cycles with all of the nozzle orifices a1 to a10 not clogged, in each of which the delay time (time difference) between the scanning commencement timing and the ejection timing varies as shown in FIGS. 9 to 12 which show the relationships between the irradiation states and the analog output waves of the received-light signal of the four cycles of scanning. Referring to these figures, the analog output waveform appears when the laser beam 39 impinges each of the ink droplets 7A to 7J. It will also be seen from these figures that the higher the degree of overlap of the laser beam and the ink droplets 7A to 7J becomes, the larger the amplitude of the analog output waveform (output voltage) becomes.

(B) When the Nozzle Orifice is Clogged (See FIGS. 13 to 17)

FIGS. 13 to 17 show a state when a part of the nozzle orifices a1 to a10 (in the embodiment shown in the figures, the nozzle orifice a6) is clogged due to, for example, viscous ink residue of a foreign substance or a solidified ink droplet b6, or failure of the ink supplying mechanism 11 to supply the ink to the nozzle orifice a6 (the part of the nozzle orifices). The relationships between the irradiation states and the analog output waves of the received-light signal of each of the four cycles of scanning are described in conjunction with FIGS. 13 to 16 as well as FIGS. 9 to 12. The scanning is performed four cycles with the part of the nozzle orifices a1 to a10 is clogged, in each of which the delay time (time difference) between the scanning commencement timing and the ejection timing varies in FIGS. 13 to 16 as well as FIGS. 9 to 12. No analog output waveform and, hence, no digital output waveform is detected during the four cycles of scanning at position corresponding to the nozzle orifice a6. Detection results similar to the situation (A) when the nozzle orifices are not clogged can be obtained at positions corresponding to other nozzle orifices.

Batches of the digital data of the received-light signals obtained from four cycles of scanning and stored in the data memory 17 are read and combined by the droplet ejection determining mechanism 35. The nozzle orifice corresponding to the position, at which no signal (waveform) showing the existence of the ink droplet is found in the combined data, is determined to be clogged. A way of a data processing for this determination is exemplary shown below. Differences between the digital data corresponding to the nozzle orifices a1 to a10 where the ink droplets b1 to b10 exist and the same corresponding to the nozzle orifices a1 to a10 where the ink droplets b1 to b10 do not exist are calculated at each of the four scanning cycles as shown in FIG. 17.

When the data obtained from any scanning cycle indicates the existence of the ink droplets b1 to b10 ejected from the nozzle orifices a1 to a10, it is determined that the ink droplets b1 to b10 are ejected from the nozzle orifices a1 to a10 safely. As to the embodiment shown in FIG. 17, the result of the logical OR operation on the digital data of the received-light signal corresponding to the nozzle orifice a6 is 0 and it is easily determined that the nozzle orifice a6 is clogged.

Second Embodiment

Figure 18:
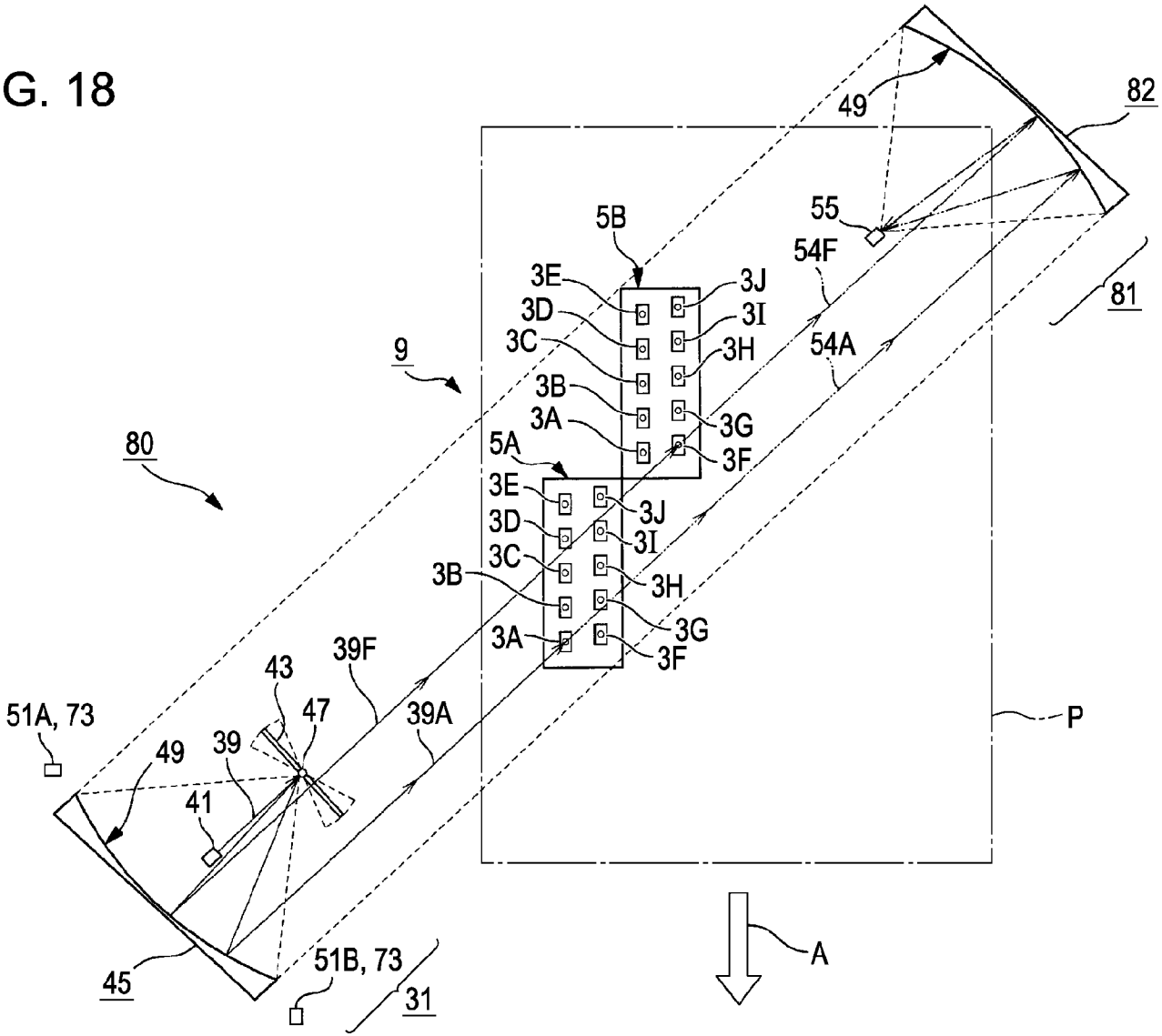
FIG. 18 is a plan view schematically illustrating a droplet-ejection detecting device according to a second embodiment.
Figure 19:
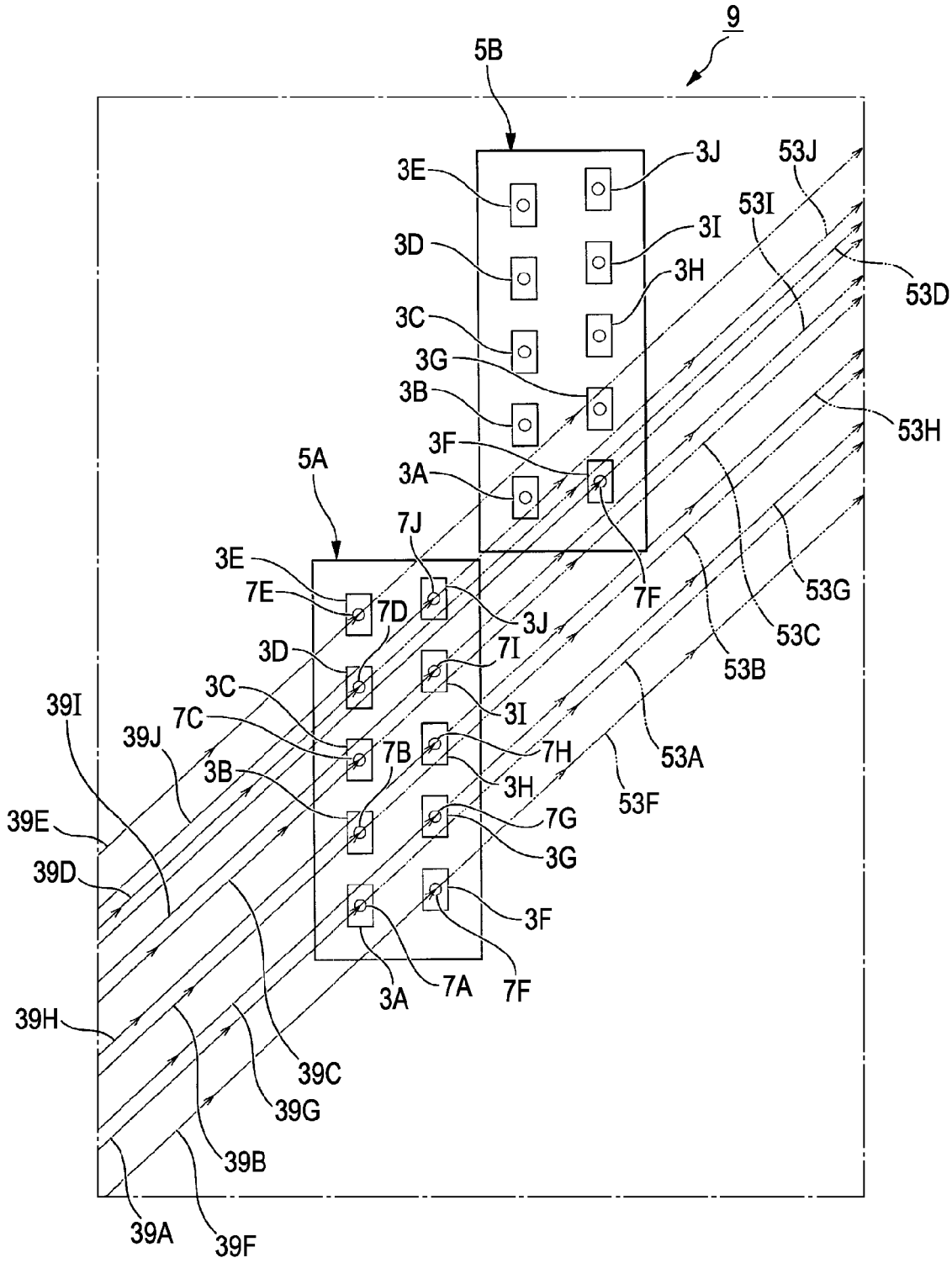
FIG. 19 shows in a greater scale the recording head modules of the same device together with an arrangement therearound.

FIG. 18 is a plan view schematically illustrating a droplet-ejection detecting device according to a second embodiment and FIG. 19 shows in a greater scale the recording head modules of the same device together with an arrangement therearound.

A droplet ejection detecting device 80 according to the second embodiment is different from the droplet-ejection detecting device 1 according to the first embodiment. The droplet ejection detecting device 80 uses a passing laser beam, in contrast to the droplet-ejection detecting device 1 which uses the reflected leaser beam 53 which is the laser beam 39 reflected on the droplets. Therefore, the structure and the location of light receiving unit 81 are also different from those of the first embodiment. The structures of the beam scanning mechanism 31 and the droplet ejection detecting mechanism 35 are the same as those of the first embodiment. However, the droplet ejection detecting device 80 is different from the droplet-ejection detecting device 1 in that the device 80 determines that the ink droplets 7A to 7J are safely ejected when the passing laser beam 54 is not detected. In other words, the device 80 determines that the ink droplets 7A to 7J are not ejected when the passing laser beam 54 is detected.

More specifically, the light receiving unit 81 is located on extensions of the momentary passing-laser-beam paths 54A to 54J of the passing laser beam 54, so as to face the laser-path changing mirror 45 across the recording head module 5. The light receiving unit 81 has a laser-path changing mirror 82 structured, for example, with a concaved mirror and the light receiving element 55. The laser-path changing mirror 82 focalizes the passing laser beam 54 on the focal point where the light receiving element 55 is located. The light receiving element 55 is located in the neighborhood and in front of the laser-path changing mirror 82, at a position between the laser-path changing mirror 82 and the recording head module 5. The beam scanning mechanism 31 and the light receiving unit 33 are separately covered with different cover structures 59 (not shown).

The droplet-ejection detecting device 80 of the second embodiment operates in a like manner as the first embodiment to offer advantages similar to those of the first embodiment.

Other Embodiments

The droplet-ejection detecting device 1 and the recording apparatus 100 incorporating the droplet-ejection detecting device 1 of the present invention have basic structures as described hereinbefore. However, it is to be understood that modifications and changes, as well as omission, of some features of the structure may be made without departing from the scope of the present invention.

For example, it is possible to make the laser-path changing mirror 45 having a focal point in the neighborhood of the beam scanning mechanism 31 in the droplet-ejection detecting device 80 of the second embodiment shown in FIGS. 18 and 19.

Figure 20:
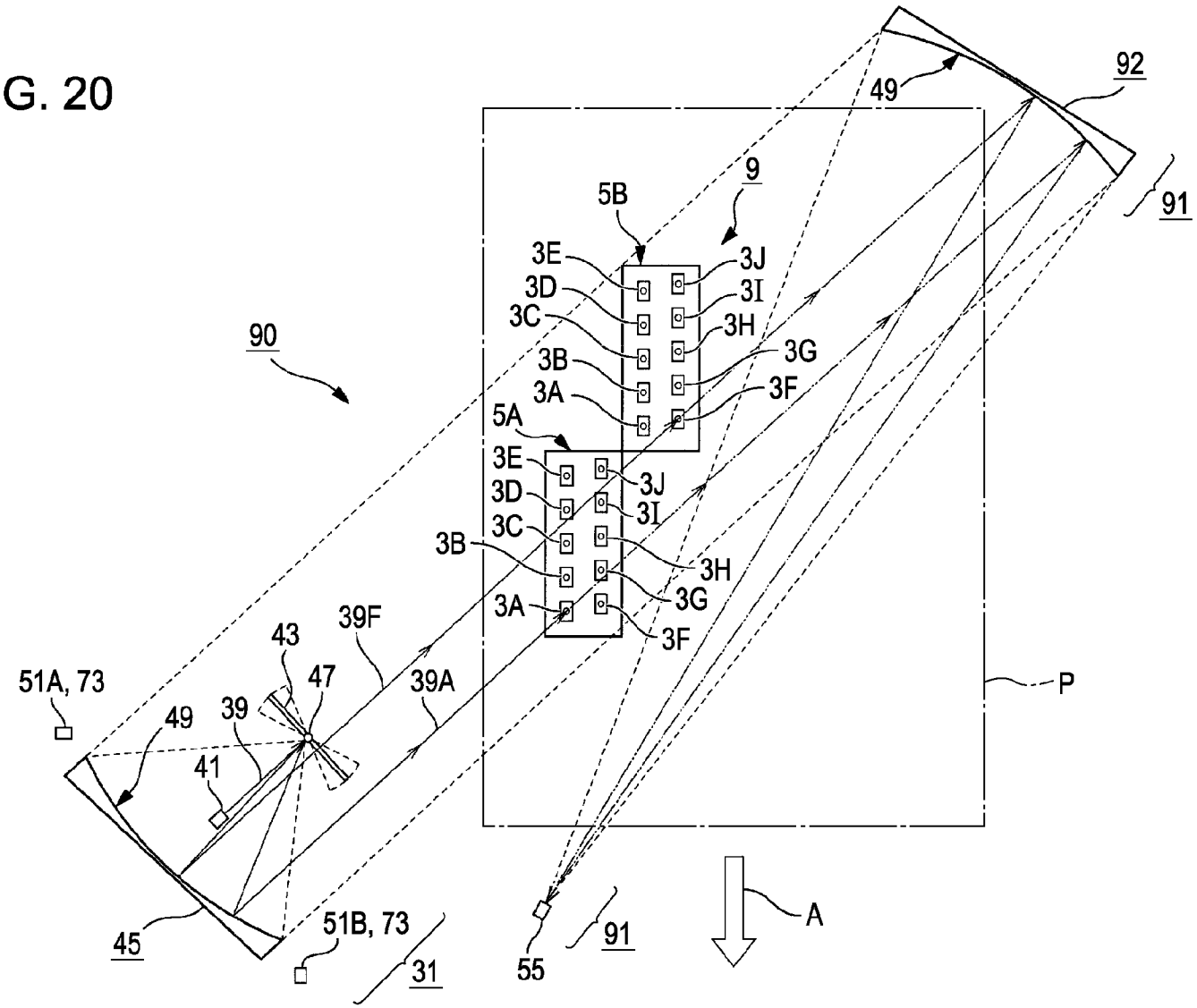
FIG. 20 is a plan view schematically illustrating a droplet-ejection detecting device according to another embodiment.

FIG. 20 shows a droplet-ejection detecting device 90 according to such an embodiment, which is structured in such a manner that the laser-path changing mirror is located at a different angle and has a different curvature of the concaved surface comparing to the mirror of the foregoing embodiments, the laser-path changing mirror 92 having a focal position in the neighborhood of the beam scanning mechanism 31, a light receiving unit 91 being provided at the focal position. A cover structure (not shown)similar to the structure 59 used in the first embodiment and shown in FIG. 4 may be used in this embodiment.

The droplet-ejection detecting devices 1, 80, and 90 may operable with not only a stationary droplet ejecting head module 5 applied to the line printer or the like but also a movable droplet ejecting head module 5 carried on a carriage reciprocately movable in the line direction. Also, the devices may be operable with an ejecting head module 5 applied to various kinds of the droplets ejection apparatuses other than the recording apparatus 100. Additionally, although the beam scanning mechanism 31 in the described embodiments performs four scanning cycles, the number of the scanning cycles may be changed to, for example, two, three, five, or more. Moreover, if all ejection from all nozzle orifices 3 can be determined at once, i.e. if all droplets ejected from all nozzle orifices except the clogged orifice are irradiated with the laser beam at once, the beam scanning mechanism 31 may be configured to perform only one scanning cycle. Also, when there are plural recording head modules 5, the ejections of the ink droplets 7 may be detected individually on every recording head modules 5.

In aforementioned embodiments, the droplet-ejection detecting device 1, 80 and 90 is configured to adjust the ejection timing to match the scanning commencement timing, however, it should be understood that the device can be configured to adjust the scanning commencement timing to match the ejection timing or any parameters can be optionally adjusted as long as the scanning commencement timing and the ejection timing have the timed relation which is varied between successive scanning cycles.

What is claimed is:

1. A droplet-ejection detecting device for detecting ejection of droplets from a plurality of nozzle orifices, comprising:

a beam scanning mechanism which scans a plurality of droplet ejection lines along which droplets ejected from the nozzle orifices fly, by emitting a beam to intersect the droplet ejection lines, thereby subjecting the droplets to irradiation with the beam;

a light receiving unit which receives light obtained as a result of the irradiation; and an ejection determining mechanism which determines safe ejections of the droplets from the nozzle orifices based on a received-light signal output from the light receiving unit, wherein the scanning is executed over a plurality of cycles in each of which the timing of the scanning and the timing of the ejection of the droplets are controlled in a timed relation to each other, the timed relation being varied between successive scanning cycles, and the election determining mechanism determines safe ejections of the droplets from the nozzle orifices based on received-light signals obtained by the plurality of cycles of scanning.

2. The droplet-ejection detecting device according to claim 1, further comprising:

a scanning commencement detector which detects a scanning commencement timing at which the scanning is commenced; and a controller which delays the ejection timing for a predetermined amount of delay time from the scanning commencement timing, the predetermined amount of delay time being varied between the successive scanning cycles, thereby varying the timed relation between successive scanning cycles.

3. The droplet-ejection detecting device according to claim 1, wherein the light receiving unit receives reflected light as the result of the irradiation, the reflected light being generated by subjecting the droplets to the irradiation with the beam, the droplets flying along the droplet ejection lines.

4. The droplet-ejection detecting device according to claim 3, wherein the light receiving unit has a light receiving element and other components, at least the light receiving element being located in neighborhood of the beam scanning mechanism.

5. The droplet-ejection detecting device according to claim 1, wherein the light receiving unit is located facing the beam scanning mechanism across the droplet ejection lines, so as to receive a passing light which reaches the light receiving unit without being blocked by a droplet when the scanning is performed over the droplet ejection lines along which the droplets fly.

6. The droplet-ejection detecting device according to claim 1, wherein the beam scanning mechanism comprises:

a beam emitting source which emits the beam; and a scanning mirror which changes a traveling direction of the beam emitted from the beam emitting source.

7. A recording device comprising:

a record performing unit having a recording head module with a plurality of nozzle orifices; and a droplet-ejection detecting device which detects ejections from the plurality of nozzle orifices, wherein the droplet-ejection detecting device is the droplet-ejection detecting device according to claim 1.

* * * * *